United States Patent [19]

Muroi

[11] Patent Number: 4,736,949

[45] Date of Patent: Apr. 12, 1988

[54] RACKET FRAME HAVING PARTICULARLY POSITIONED GRIP

[75] Inventor: Kunimasa Muroi, Hamamatsu, Japan

[73] Assignee: Nippon Gakki Seizo Kabushiki Kaisha, Japan

[21] Appl. No.: 904,412

[22] Filed: Sep. 8, 1986

[30] Foreign Application Priority Data

Oct. 16, 1985 [JP] Japan ..... 60-158351[U]

[51] Int. Cl.[4] ..... A63B 49/08

[52] U.S. Cl. ..... 273/73 J; 273/DIG. 8

[58] Field of Search ..... 273/73 R, 73 J, 75, 273/81 R, 67 DA; 81/22, 489

[56] References Cited

U.S. PATENT DOCUMENTS 4,205,844 6/1980 Gombas ..... 273/73 J X

FOREIGN PATENT DOCUMENTS 2106800 9/1971 Fed. Rep. of Germany ..... 273/73 J 123235 10/1978 Japan ..... 273/73 J

*Primary Examiner*—Matthew L. Schneider

*Attorney, Agent, or Firm*—Lerner, David, Littenberg, Krumholz & Mentlik

[57] ABSTRACT

The present invention provides a racket frame with a grip which includes an inner low rigidity layer embracing the rear end section of a shaft and an outer high rigidity layer embracing the inner low rigidity layer and partly in direct contact with the shaft, the direct contact being at the position of the node of the primary vibration transmitted through the shaft when striking a ball.

3 Claims, 1 Drawing Sheet

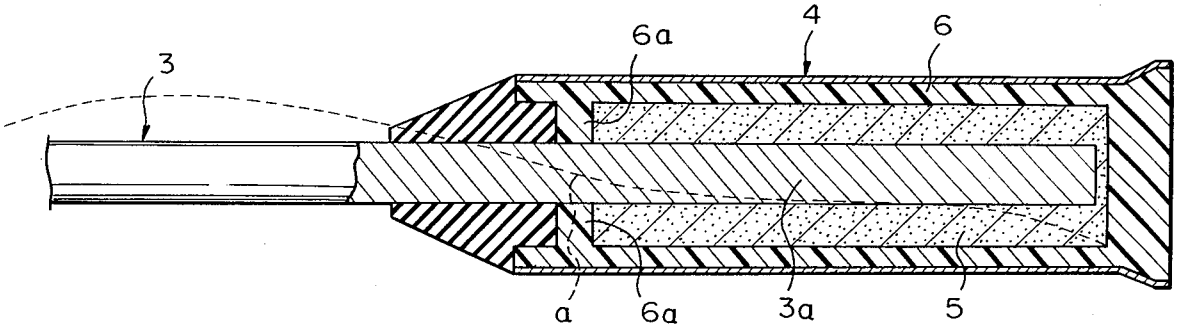
6
4
6a
3
5
3a
6a
a

RACKET FRAME HAVING PARTICULARLY POSITIONED GRIP

BACKGROUND OF THE INVENTION

The present invention relates to an improved racket frame, and more particularly relates to an improvement in grip of a racket such as a tennis racket.

In general, a racket frame of the above-described sort includes an oval head, a shaft connected to the head via a throat and a grip formed around the rear end section of the shaft.

In one conventional example, the grip takes the form of a low rigidity shell embracing the rear end section of the shaft. The low rigidity shell is made of a material of low rigidity such as foam synthetic resin. With this conventional construction of the grip, not only the primary vibration but also secondary and higher vibrations are damped, thereby deteriorating feel on the hand.

In another conventional example, the grip takes the form of a high rigidity shell encompassing the rear end section of the shaft via radial arms. The high rigidity shell is made of a material of high rigidity. With this construction, however, the primary vibrations of the shaft at striking balls are directly transmitted to the player's hand due to the high rigidity of the grip, thereby causing uncomfortable feel on the hand.

SUMMARY OF THE INVENTION

It is the object of the present invention to reduce uncomfortable feel on hand at striking balls which is mostly caused by the primary mode vibration transmitted through the shaft and to positively assure excellent feel on the hand by permitting secondary and higher vibrations to be transmitted to the hand.

In accordance with the basic concept of the present invention, a grip includes an inner low rigidity layer embracing the rear end section of a shaft and an outer high rigidity layer embracing the inner low rigidity layer and partly contacted to the shaft.

BRIEF DESCRIPTION OF THE DRAWING

The attached drawing is a side view, partly in section, of the grip of a racket frame in accordance with the present invention.

DESCRIPTION OF THE PREFERRED EMBODIMENTS

The grip 4 of the racket frame in accordance with the present invention is formed on the rear end section *3a* of the shaft 3. That is, the rear section *3a* of the shaft 3 is fully embraced by a low rigidity layer 5 made of a material of low rigidity at the level of several ten kg/mm$^2$ or lower and of high damping characteristics such as foam synthetic resin. Most typically, the foam synthetic resin includes hard polyurethane resin and elastic polyurethane resin. The low rigidity layer 5 is further fully embraced by a high rigidity layer 6 made of a material of high rigidity at the level of several hundred kg/mm$^2$ or higher and made of non-foam synthetic resin. Most typically the non-foam synthetic resin includes polyamide resin, ABS resin, polyacetal resin, AS resin and FRP (fiber reinforced plastics). The high rigidity layer 6 includes an inner flange *6a* partly but directly embracing or contacting the rear end section *3a* of the shaft 3. Most preferably, the inner flange *6a* should be located at the position of the node "a" of the primary mode vibration generated in the shaft 3 at striking balls. Such a primary mode vibration is shown with a dot line in the illustration.

Even the primary mode vibration is generated in the shaft 3 at striking balls, no shock is transmitted to the player's hand since the primary mode vibration of the rear end section *3a* of the shaft 3 is well damped by the low rigidity layer 5. Secondary and higher mode vibrations are transmitted to the player's hand via the inner flange *6a* of the high rigidity layer 6 of the grip 4, thereby assuring excellent feel at hitting balls. Further, deformation of the inner low rigidity layer 5 is well restrained by the outer high rigidity layer 6. In addition, a part of elastic waves is reflected at the border between the both layers 5 and 6 without posing ill influence on the player's hand.

The sections of the racket frame other than the grip may be made of any known materials such as the one with a FRP shell, Al alloys, Ti alloys and stainless steel.

I claim:

1. An improved racket frame comprising a shaft and a grip formed on the rear end section of said shaft, said grip including an inner low rigidity layer embracing said rear end section of said shaft and an outer high rigidity layer embracing said low rigidity layer, said inner and outer layers being of different rigidity, said outer high rigidity layer being in direct contact with the rear end section of the shaft only at the position of the node of the primary vibration transmitted through said shaft when striking a ball.

2. The improved racket frame as claimed in claim 1 in which said inner low rigidity layer is made of foam synthetic resin.

3. The improved racket frame according to claim 1 in which said outer high rigidity layer is made of non-foam synthetic resin.

* * * * *